US008291899B2

(12) United States Patent
Fukasawa

(10) Patent No.: US 8,291,899 B2
(45) Date of Patent: Oct. 23, 2012

(54) SNORKEL

(75) Inventor: Shunji Fukasawa, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 501 days.

(21) Appl. No.: 12/554,343

(22) Filed: Sep. 4, 2009

(65) Prior Publication Data

US 2010/0132701 A1 Jun. 3, 2010

(30) Foreign Application Priority Data

Dec. 2, 2008 (JP) ..... 2008-307873

(51) Int. Cl.
*B63C 11/16* (2006.01)
*B63C 11/02* (2006.01)
*A61M 16/00* (2006.01)

(52) U.S. Cl. ..... 128/201.11; 128/200.29; 128/201.27; 128/207.14; 128/207.15; 128/207.16

(58) Field of Classification Search ..... None
See application file for complete search history.

(56) References Cited

U.S. PATENT DOCUMENTS 5,404,872 A * 4/1995 Choi ..... 128/201.11
5,487,379 A * 1/1996 Koshiishi ..... 128/201.11
6,679,253 B1 * 1/2004 Feng ..... 128/201.11
6,994,085 B2 * 2/2006 Shiue ..... 128/201.11
2004/0063815 A1 * 4/2004 Kinose et al. ..... 523/205
2004/0079366 A1 * 4/2004 Kawashima et al. .... 128/201.11

FOREIGN PATENT DOCUMENTS

JP 3107042 11/2004

* cited by examiner

*Primary Examiner* — Justine Yu
*Assistant Examiner* — Christopher Miller
(74) *Attorney, Agent, or Firm* — Clark & Brody

(57) ABSTRACT

A snorkel is provided on an upper end section of a conduit with an opening for breathing and a valve adapted to open and to close the opening. The valve is pivotally mounted on an upper end section of the conduit via arms integral with the valve. Below the valve, there are provided two or more floats. The respective floats are housed inside an annular housing defined outside the upper end section of the conduit in a manner that these floats may move up- and downward. When any one of these two or more floats is given buoyancy and moves upward, the arms are reliably actuated upward and thereby the valve reliably closes the opening.

5 Claims, 7 Drawing Sheets

SNORKEL

BACKGROUND OF THE INVENTION

The present invention relates to a diving snorkel.

There are known diving snorkels comprising a conduit tube for breathing provided at its lower end section with a mouthpiece and at its upper end section with a breathing opening port. There is also known a snorkel including a closure element in the form of a valve serving to open and to close the opening is also known, for example, in Japanese Unexamined Utility Model Application Publication No. 3107042. In the case of the snorkel, the closure element maintains the top opening in its closed state as long as the upper end section of the conduit tube is exposed above the water surface. With the upper end section of the conduit tube being submerged below the water surface, a float is given buoyancy, moves upward and actuates the closure element to close the opening. In this way, water should not flow into the conduit tube even when the upper end section of the snorkel is submerged below the water surface.

In the case of the snorkel disclosed in the aforesaid Publication, a single float provided immediately below a closure element forces the closure element to move upward and thereby to close a breathing opening as the single float is given buoyancy and moves upward. The closure element and the float are operatively coupled to each other via a movable rod pivotally mounted on the conduit tube for breathing. With such construction of the float, it depends on the angularity of the conduit tube relative to the water surface whether the flat can smoothly move upward or not. Should the float be prevented from smoothly moving upward, it will be difficult for the closure element to close the opening rapidly.

SUMMARY OF THE INVENTION

It is an object of the present invention to improve the conventional snorkel so that the opening of the conduit tube can be rapidly closed irrespectively of the angularity of the conduit tube relative to the water surface.

According to the present invention, there is provided a snorkel comprising a breathing conduit extending in a vertical direction, a mouthpiece mounted on a lower end of the conduit, a breathing opening formed in an upper end section of the conduit, a valve mounted on an upper end section of the conduit to open and to close the opening from outside and a float adapted to move in the vertical direction when given buoyancy to actuate the valve to close the opening and thereby to prevent water from flowing into the conduit.

The present invention has the following aspects. The valve is mounted, in a pivotal manner in the vertical direction, on an outer surface of a peripheral wall of the conduit by intermediary of arms integral with the valve so that the valve rotates downward in the vertical direction to maintain the opening in its open state as long as the upper end section of the conduit is exposed above water surface. The float comprises two or more floats allocated circumferentially of the conduit and housed, in a movable manner in the vertical direction, inside a housing provided outside the upper end section of the conduit and having an annular cross-sectional shape in a diametric sectional view of the conduit. The housing includes water passages allowing water to flow thereinto when the housing is submerged below the water surface and gives the floats buoyancy, respectively, so that the floats individually move upward in the vertical direction and, when the housing is exposed above the water surface, allowing the floats to move downward individually under their own weight. The arms are thereby rotated upward so as to actuate the valve to close the opening when any one of two or more floats is given the buoyancy and moves upward in the vertical direction.

According to one preferred embodiment of the invention, two or more floats are a first float and a second float adjacent to each other about a center line of the valve bisecting the valve in the circumferential direction of the conduit.

According to another preferred embodiment of the invention, the housing is mounted on the upper end section of the conduit in a manner that the upper end section of the conduit and the housing are engaged with each other slidably in the vertical direction by intermediary of first fitting means formed on an outer surface of the peripheral wall along the upper end section so as to extend in the vertical direction and second fitting means formed on the inner surface of the housing having the annular shape in the diametric sectional view so as to extend in the vertical direction and wherein each of the first fitting means is one of a flange and a groove and each of the second fitting means is the other one of these flange and groove.

According to still another preferred embodiment of the invention, the upper end section and the housing are formed of a hard thermoplastic synthetic resin.

The float of the snorkel according to the present invention comprises the first float and the second float located to be adjacent to each other about a center line of the valve bisecting this valve in the circumferential direction of the conduit. With such unique arrangement, irrespectively of whether the upper end section of the conduit is vertical to the water surface or at a slant relative to the water surface when the upper end section is submerged from above the water surface into water below the water surface, the valve can be actuated upward and thereby to close the opening rapidly so far as at least one of the first and second floats is given and moves upward.

DETAILED DESCRIPTION OF THE PREFERRED EMBODIMENTS

Details of a diving snorkel according to the invention will be more fully understood from the description made hereunder with reference to the accompanying drawings.

Figure 1:
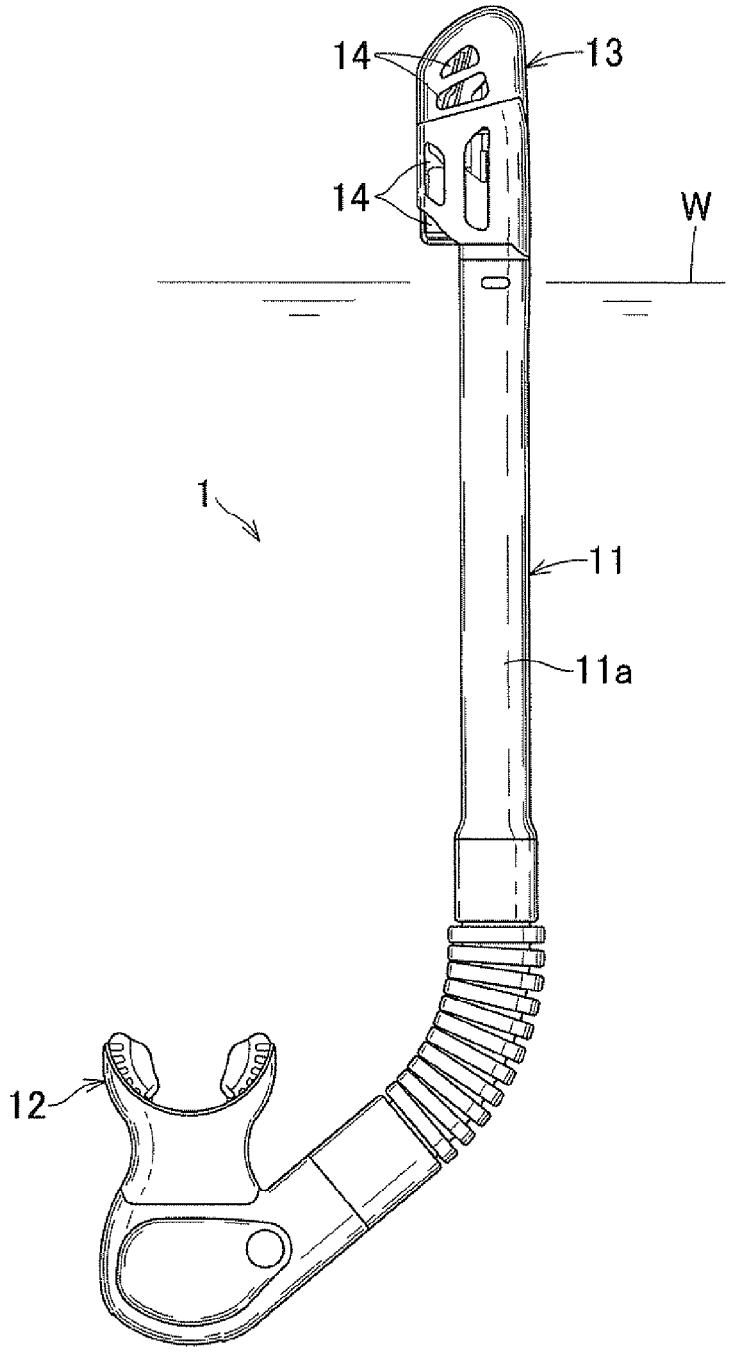
FIG. 1 is an overall view of a diving snorkel.

FIG. 1 is an overall view exemplarily showing a snorkel 1 together with a position of the water surface W relative to the snorkel 1. The snorkel 1 includes a breathing conduit 11 extending from above the water surface W to below the water surface as viewed in a vertical direction. The conduit tube 11 is provided at a lower end thereof with a mouthpiece 12 and at an upper end with an attachment 13. It should be appreciated that the attachment 13 has a side geometry as shown in FIG. 1 and is formed with a plurality of air/water passages 14 allowing not only breathing of a user wearing the snorkel 1 but also water to pass through the passages 14 into and out from the attachment 13.

Figure 2:
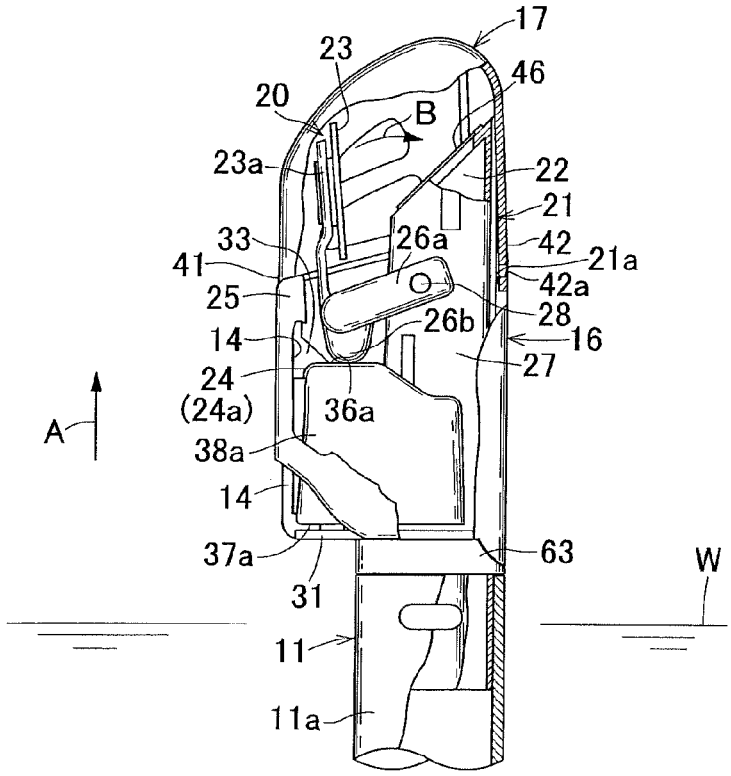
FIG. 2 is a partially cutaway side view of an attachment.
Figure 3:
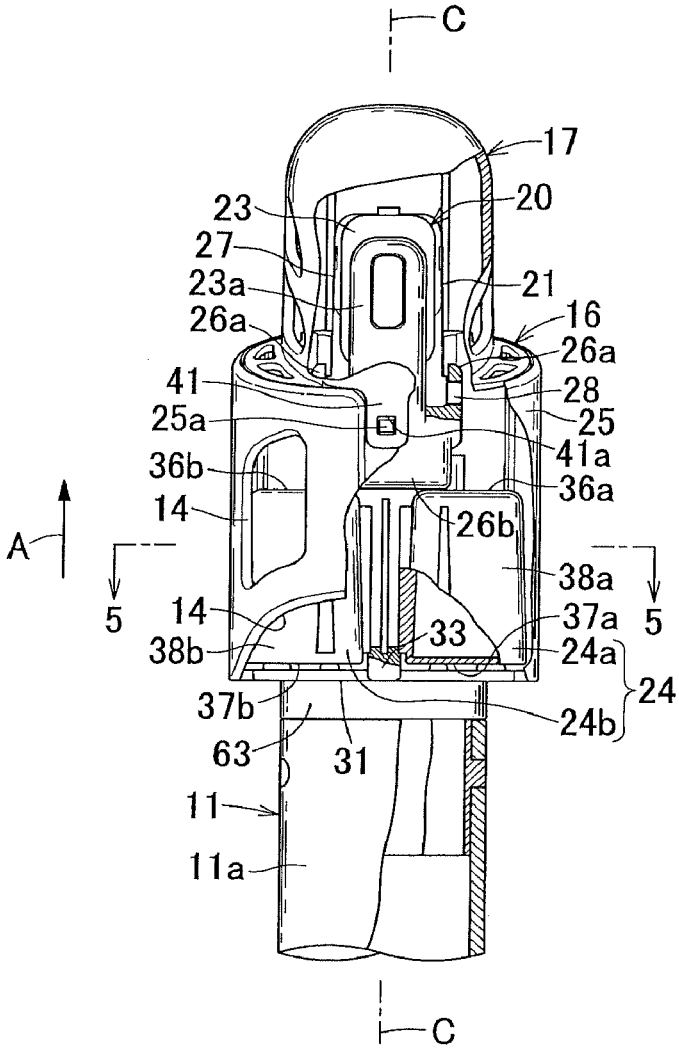
FIG. 3 is a partially cutaway front view.

FIG. 2 is a partially cutaway side view and FIG. 3 is a partially cutaway front view of the attachment 13. FIG. 2 shows the attachment 13 in a larger scale than in FIG. 1 as partially broken away. FIG. 3 a chain line C-C is a center line bisects a transverse dimension of the attachment 13. As seen from the front, the attachment 13 is bilaterally symmetric about this center line C-C and includes a housing 16 and a cap 17 which is detachable from the housing 16. FIGS. 2 and 3 show the cap 17 detached from the housing 16. The housing 16 surrounds an end conduit 21 defining an upper end section of the conduit 11 and allows passage of air/water. The end conduit 21 is provided along a main section 11*a* of the conduit 11 extending from the mouthpiece 12 toward the attachment 13. Specifically, the end conduit 21 is provided at its top section with a breathing opening 22 and in a peripheral wall 27 with a valve assembly 20 comprising a valve 23 adapted to control opening and closing of the opening 22 and a support 23*a* for this valve 23. A float 24 underlies the valve 23 between the end conduit 21 and the housing 16. The housing 16 has a peripheral wall 25 (See FIG. 5) surrounding the end conduit 21, the valve assembly 20 and the float 24.

The housing 16 has, in addition to the peripheral wall 25, a bottom wall 31 and the peripheral wall and bottom wall 25, 31 are formed with a plurality of air/water passages 14 and a plurality of air/water passages 32 (See FIG. 6), respectively, providing for passage of air as well as passage of air between the interior side and the exterior side of the housing 16.

The valve assembly 20 comprises the valve 23 made of a soft elastic material such as natural rubber or silicon rubber mounted on the support 23*a* made of a relatively hard thermoplastic synthetic resin such as a polypropylene resin or an ABS resin wherein the support 23*a* is integrally formed with a pair of arms 26*a* and a float contact portion 26*b*. The arms 26*a* are pivotally mounted on associated shafts 28 projecting from the outer surface of the wall 27 of the end conduit 21 so that the arms 26*a* may pivot about the respective shafts 28 in a direction indicated by an arrow B (See FIG. 2) and the valve 23 also may pivot about the shafts 28 in the direction indicated by the arrow B to close the 22 of the end conduit 21 (See FIG. 4).

As will be apparent from FIG. 3, the float 24 comprises a pair of floats, i.e., a first float 24*a* and a second float 24*b* arranged in a symmetric relationship about the center line C-C. Between the first flat 24*a* and the second float 24*b*, a partition wall 33 is provided, which bisects an inner space of the housing 16 in the transverse direction of FIG. 3 and being contiguous to the inner surface of the peripheral wall 25 of the housing 16 (See FIG. 5). The first and second floats 24*a*, 24*b* are hollow elements respectively having top walls 36*a*, 36*b*, bottom walls 37*a*, 37*b* and peripheral walls 38*a*, 38*b* (See FIG. 5). The floats 24*a*, 24*b* may be guided by the inner surface of the peripheral wall 25 of the housing 16, the partition wall 33 and the peripheral wall 27 of the end conduit 21 located on the inside of the housing 16 to move upward in parallel with the center line C-C in a direction indicated by an arrow A and to move downward in the opposite direction. The float contact portion 26*b* of the support 23*a* constituting the valve assembly 20 are kept always in contact with the top walls 36*a*, 36*b* of the first and second floats 24*a*, 24*b*.

A peripheral wall of the cap 17 locally extend downward further than the remainder to define a front tongue 41 and a rear tongue 42 adapted to be detachably snap-engaged with the housing 16 and the end conduit 21, respectively (See FIG. 2) The front tongue 41 is formed with a through-hole 41*a* (See FIG. 3) for such snap-engagement and the rear tongue 42 also is formed with a through-hole 42*a* (See FIG. 2) for the snap-engagement. The peripheral wall 25 of the housing 16 is formed on the outer surface thereof with a small projection 25*a* (See FIG. 3) adapted to be snap-engaged with the front tongue 41 and the peripheral wall 27 of the end conduit 21 is formed in a region thereof not shielded by the housing 16 with a small projection 21*a* (See FIG. 2) adapted to be snap-engaged with the rear tongue 42. Use of the cap 17 protects operation of the valve assembly 20 from undesirable affection by water wave and/or floating objects.

Figure 4:
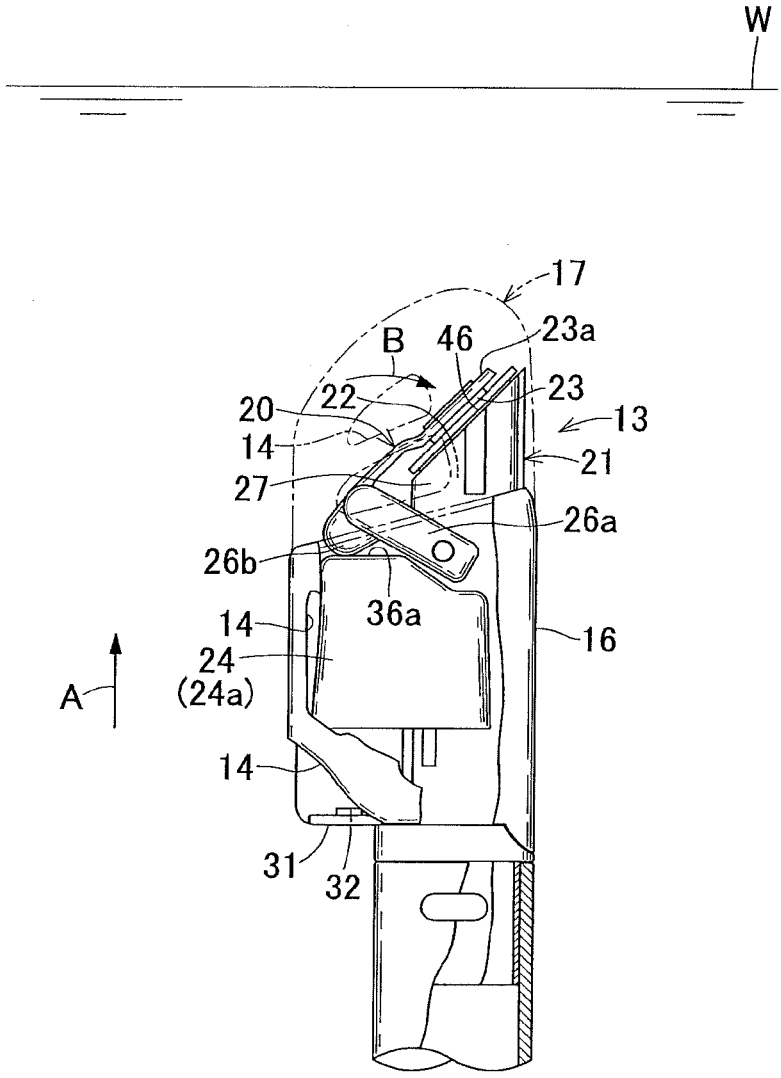
FIG. 4 is a view similar to FIG. 2, showing a headpiece with a valve being in a closed position.

FIG. 4 is a view similar to FIG. 2, showing the attachment 13 submerged under the water surface W and the opening 22 of the valve 23 closed. It should be appreciated that the FIG. 4 shows the cap 17 by imaginary lines in its detached state in order to show the state of the valve 23 as clearly as possible. Assumed that the attachment 13 begins to be submerged from the state as shown in FIG. 2 below the water surface W, water begins to flow into the housing 16 through the air/water passages 14 formed in the housing 16 and the cap 17, on one hand, and through the water/air passages 32 (See FIG. 6) formed in the bottom wall 31 of the housing 16, on the other hand. In consequence, the first and second floats 24*a*, 24*b* are given buoyancy and move upward in the direction as indicated by the arrow A. The support 23*a* as a component of the valve assembly 20 is kept in contact, at the float contact portion 26*b*, with the top walls 36*a*, 36*b* of the first and second floats 24*a*, 24*b* and therefore the first and second floats 24*a*, 24*b* moving upward function to give a lift to the arm 26*a* and thereby to rotate the valve 23 in a direction as indicated by the arrow B until the valve 23 comes in close contact with a valve seat 46 formed around the port 22 of the end conduit 21. With the valve 23 in this state, it is possible for the snorkel 1 to prevent water from flowing into the conduit tube 11 through the port 22.

The amount of water having flown into the housing 16 and the cap 17 is drained out therefrom through the water/air passage holes 14, 32 as the attachment 13 of the snorkel 1 having been submerged below the water surface Was illustrated by FIG. 4 moves upward above the water surface W. In response to this, the first and second floats 24*a*, 24*b* descend under their own weight. Specifically, the first and second floats 24*a*, 24*b* descend in the direction opposite to the direction as indicated by the arrow A and move back to the state as shown by FIG. 2. Thereupon the valve assembly 20 having closed the port 22 till then rotates under its own weight in the direction opposite to the direction as indicated by the arrow B and thereby makes the port 22 breathable.

Figure 5:
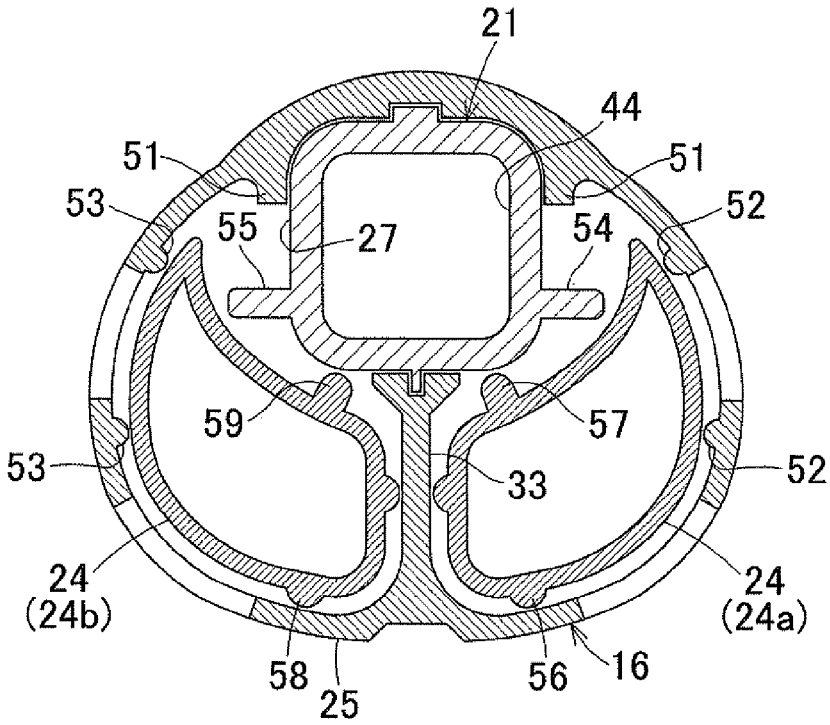
FIG. 5 is a sectional view taken along the line V-V in FIG. 3.

FIG. 5 is a sectional view taken along a line V-V in FIG. 3. As will be apparent from this sectional view, the annular peripheral wall 25 of the housing 16 is formed on the inner surface thereof with the partition wall 33 lying between the first float 24*a* and the second float 24*b*, a pair of first ribs 51 for positioning of the end conduit 21, a pair of second ribs 52 adapted to contact with the first float 24*a* and a pair of third ribs 53 adapted to contact with the second float 24*b*. A hollow space 44 defined inside the peripheral wall 27 of the end conduit 21 extends toward the opening 22, on one hand, and toward the main section 11*a* of the conduit 11, on the other hand. The peripheral wall 27 is formed with a fourth rib 54 adapted to contact with the first float 24*a* and a fifth rib 55 adapted to contact with the second float 24*b*. Both the first float 24*a* and the second float 24*b* are water-tight hollow bodies wherein the first float 24*a* is formed with a sixth rib 56 adapted to contact with the inner surface of the peripheral wall 25 defining the housing 16 and a seventh rib 57 adapted to contact with the end conduit 21. In a similar fashion, the second float 24*b* is formed with an eighth rib 58 adapted to contact with the inner surface of the peripheral wall 25 and a ninth rib 59 adapted to contact with the end conduit 21.

Relative to the second through fifth ribs 52, 53, 54, 55, the first and second floats 24*a*, 24*b* are slidably movable in the direction as indicated by the arrow A in FIG. 2 as well as in the direction opposite thereto, i.e., in a vertical direction as viewed in FIG. 2. The sixth through ninth ribs 56, 57, 58, 59 are slidably movable relative to the housing 16 as well as to the end conduit 21. Preferably, the second through ninth ribs 52 through 59 are respectively adapted to line-contact with the associated elements without interfering with movement of the first and second floats 24*a*, 24*b* in the vertical direction.

Figure 6:
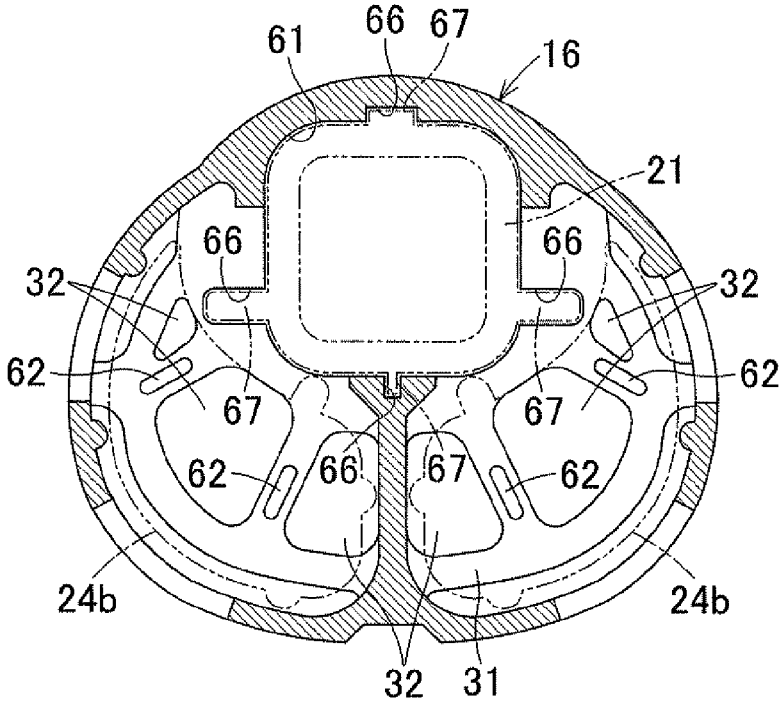
FIG. 6 is a view similar to FIG. 5, showing the inner side of a guide.

FIG. 6 is a view similar to FIG. 5, showing the inner side of the housing 16 wherein the end conduit 21, the first float 24*a* and the second float 24*b* housed within the housing 16 are indicated by imaginary lines. The bottom wall 31 of the housing 16 entirely seen in FIG. 6 is formed with a guide 61 allowing the end conduit 21 to be inserted into the housing 16 in the direction as indicated by the arrow A (See FIG. 2) the plurality of air/water passages 32 and a plurality of ridges 62. The ridges 62 are defined by regions protruding upward toward the upper section of the housing 16 from the inner surface of the bottom wall 31. The ridges 62 facilitate water to flow into gaps defined between the inner surface of the bottom wall 31 and the bottom walls 37*a*, 37*b* of the first and second floats 24*a*, 24*b*, respectively. The guide 61 is shaped and dimensioned so that the end conduit 21 having the valve assembly 20 detached therefrom can be smoothly inserted into the housing 16 from below the bottom wall 31. Upon insertion of the end conduit 21 into the housing 16 by a predetermined dimension, a basal portion 63 (See FIGS. 2 and 3) comes in contact with the bottom wall 31 of the housing 16 from below and no further insertion becomes impossible. After insertion of the end conduit 21 in this manner, the first float 24*a* and the second float 24*b* may be placed within the housing 16 from above as seen in FIG. 5 and thereafter the valve assembly 20 may be mounted on the shaft 28 of the end conduit 21 by elastically opening a pair of the arms 26*a* constituting the valve assembly 20. The cap 17 may moved downward in the vertical direction from the positions as shown in FIG. 2 to bring the front tongue 41 into snap-engagement with the small projection 25*a* formed on the housing 16 and to bring the rear tongue 42 into snap-engagement with the small projection 21*a* formed on the end conduit 21. In this way, assembling of the attachment 13 is completed. After the end conduit 21 has been integrated with the attachment 13 in this manner, the basal portion 63 of the end conduit 21 may be inserted into the main section 11*a* of the conduit 11 (See FIGS. 2 and 3). Referring to FIGS. 5 and 6, the housing 16 and the end conduit 21 inserted into the housing 16 are slidably engaged with each other from the direction as indicated by the arrow A via a plurality of the grooves 66 formed on the housing 16 and a plurality of flanges 67 formed on the end conduit 21. However, the present invention is not limited to such arrangement and may be exploited also in a manner that a plurality of the flanges 67 formed on the housing 16 are engaged with a plurality of grooves formed on the end conduit 21. The housing 16 and the end conduit 21 are fixed to each other by bringing the cap into snap-engagement with the assembly of the housing and end conduit 16, 21.

Figure 7:
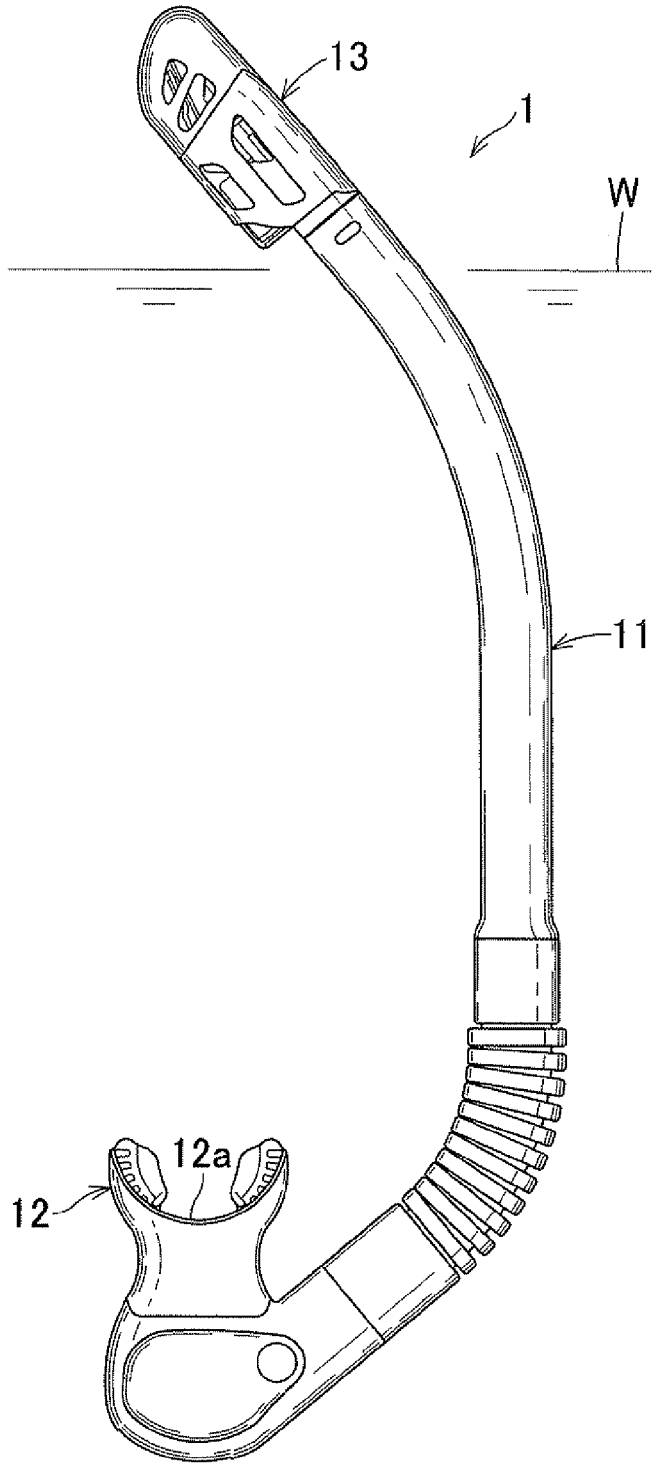
FIG. 7 is a view similar to FIG. 1, showing an alternative embodiment.

FIG. 7 is a view similar to FIG. 1, exemplarily showing an alternative embodiment of the invention. In the case of the snorkel 1 shown in FIG. 7, an opening 12*a* of the mouthpiece 12 exactly faces the water surface W but the end conduit 21 defining the upper end section of the conduit 11 and the attachment 13 mounted on this end conduit 21 are slanted with respect to the water surface W. In the case of this snorkel 1 also, when any one of the first float 24*a* and the second float 24*b* is given buoyancy, the valve 23 will be rotated to close the opening 22 of the end conduit 21.

In the snorkel 1 of such construction, the respective hollow volumes of the first and second floats 24*a*, 24*b* are predetermined so that, if at least one of the first float 24*a* and the second float 24*b* moves upward in the snorkel 1 of such construct, this float 24*a* may push the float contact portion 23*b* of the support 23*a* to force the arm 26*a* upward, thereby to rotate the valve 23 in the direction of the arrow B and to close the opening 22. The valve 23 is formed of a sufficiently flexible elastic material to come smoothly in close contact with the valve seat 46 and to seal the interior of the end conduit 21 in water-tight condition. The elements constituting the attachment 13 except the valve 23 may be obtained by molding a hard thermoplastic synthetic resin using an appropriate one of well known molding processes such as the injection molding process. However, it should be appreciated that it is also possible to obtain the first and second floats 24*a*, 24*b* by blow molding a hard or soft thermoplastic synthetic resin.

The inventive snorkel 1 is not limited to the embodiments exemplarily shown in FIGS. 1 and 7. For example, the float 24 used to rotate the valve assembly 20 in the direction of arrow B and thereby actuate the valve 23 so as to close the opening 22 may comprise three or more floats. Even when three or more floats are used, the floats should be allocated so as to be circumferentially adjacent one another within the inner space of the housing 16 having an annular shape in a sectional view of the conduit taken in its cross-sectional shape as taken in a diametrical direction. Between the circumferentially adjacent floats, the partition wall 33 or the like may be provided to avoid undesirable interference between each pair of the adjacent floats when the respective floats move up- and downward. With the unique arrangement as has been described above, it is assured that any one of these two or more floats may be given buoyancy and actuate the valve 23 to close the opening 22 as soon as the upper section of the conduit 11 begins to be submerged in vertical or slant posture relative to the water surface W.

The entire discloses of Japanese Patent Application No. 2008-307873 filed on Dec. 2, 2008 including specification, drawings and abstract are herein incorporated by reference in its entirety.

What is claimed is:

1. A snorkel comprising:

a breath conduit extending in a vertical direction;

a mouthpiece mounted on a lower end of said breath conduit;

a breath opening port formed in an upper end section of said breath conduit;

a valve mounted on the upper end section of said breath conduit to open and to close said breath opening port from outside;

a first float and a second float adapted to move in said vertical direction when given buoyancy to actuate said valve to close said breath opening port and thereby to prevent water from flowing into said breath conduit;

said valve being mounted, in a pivotal manner in said vertical direction, on an outer surface of a peripheral wall of said breath conduit by intermediary of arms integral with said valve so that said valve rotate downward in said vertical direction to maintain said breath opening port in its open state as long as said upper end section of said breath conduit is exposed above water surface;

said first float and said second float allocated circumferentially of said breath conduit and housed, in a movable manner in said vertical direction, inside a housing provided outside said upper end section of said breath conduit and having an annular cross-sectional shape in a diametric sectional view of said breath conduit;

said housing including water passages allowing water to flow thereinto when said housing is submerged below said water surface and gives said first float and said second float buoyancy, respectively, so that said first float and said second float may individually move upward in said vertical direction and, when said housing is exposed above said water surface, allowing said first float and said second float to move downward individually under their own weight; and said arms being thereby rotated upward so as to actuate said valve to close said breath opening port, when any one of said first float and said second float is given said buoyancy and moves upward in said vertical direction; and said first float and said second float are separately adjacent to each other about a center line of said valve bisecting said valve in the circumferential direction of said breath conduit, wherein each of said first float and said second float is formed with a rib adapted to contact with the inner surface of the peripheral wall defining said housing and a rib adapted to contact with said upper end section of the breath conduit.

2. The snorkel defined by claim 1, wherein said housing is mounted on said upper end section of said breath conduit in a manner that the upper end section of said breath conduit and said housing are engaged with each other slidably in said vertical direction by intermediary of first fitting means formed on an outer surface of said peripheral wall along said upper end section so as to extend in said vertical direction and second fitting means formed on an inner surface of said housing having the annular shape in said diametric sectional view so as to extend in said vertical direction and wherein each of said first fitting means is one of a flange and a groove and each of said second fitting means is the other one of these flange and groove.

3. The snorkel defined by claim 1, wherein said upper end section and said housing are formed by a thermoplastic synthetic resin.

4. The snorkel defined by claim 1, wherein the peripheral wall of the housing is formed on the inner surface thereof with a partition wall defining said center line and lying between said first and second floats, and said peripheral wall is formed with a pair of first ribs for positioning of the upper end section of the breath conduit, a pair of second ribs adapted to contact with said first float and a pair of third ribs adapted to contact with said second float.

5. The snorkel defined by claim 1, wherein the peripheral wall of the upper end section of the breath conduit is formed with a rib adapted to contact with said first float and a rib adapted to contact with said second float.

* * * * *